US006561813B2

(12) United States Patent
Rutten et al.

(10) Patent No.: US 6,561,813 B2
(45) Date of Patent: May 13, 2003

(54) ROTATION CONNECTOR AND A METHOD OF MAKING THE SAME

(75) Inventors: Hendrik Gerard Jozef Rutten, Ek Arcen (NL); Klaas Verzijl, Eh Well (NL)

(73) Assignee: Océ-Technologies B.V., MA Venlo (NL)

( * ) Notice: Subject to any disclaimer, the term of this patent is extended or adjusted under 35 U.S.C. 154(b) by 0 days.

(21) Appl. No.: 10/058,171

(22) Filed: Jan. 29, 2002

(65) Prior Publication Data

US 2002/0102867 A1 Aug. 1, 2002

(30) Foreign Application Priority Data

Jan. 30, 2001 (NL) ..... 1017236

(51) Int. Cl.[7] ..... H01R 39/00
(52) U.S. Cl. ..... 439/26; 439/28
(58) Field of Search ..... 439/26, 21–25, 439/20, 27, 28, 668, 669, 10, 13; 29/597; 310/232

(56) References Cited

U.S. PATENT DOCUMENTS 2,926,326 A 2/1960 Boily et al. ..... 439/21
2,967,283 A * 1/1961 Medney ..... 439/85
3,370,263 A 2/1968 Rainer ..... 439/24
3,686,514 A * 8/1972 Dube et al. ..... 310/232
4,447,752 A * 5/1984 Boyce et al. ..... 310/232
5,557,975 A * 9/1996 Crane et al. ..... 73/862.338

FOREIGN PATENT DOCUMENTS

FR 562 150 A 11/1923
GB 617 762 A 2/1949
NL 6 911 697 A 2/1971

* cited by examiner

*Primary Examiner*—P. Austin Bradley
*Assistant Examiner*—Ross Gushi
(74) *Attorney, Agent, or Firm*—Birch, Stewart, Kolasch & Birch, LLP

(57) ABSTRACT

A rotation connector, or slip ring, adapted to the transmission of electrical signals from a first device to a second device, which second device is rotatable with respect to the first device, wherein the connector includes a substantially dielectric support member having a longitudinal direction and provided with a first end portion and a second end portion, the surface of the support member being provided with an electrically conductive track extending longitudinally as far as the region of the second end. A self-supporting contact ring with a substantially circular electrically conductive peripheral edge is pushed over said support member and fixed thereto, such that the peripheral edge of the contact ring is in connection with the electrically conductive tracks via an electrically conductive path.

19 Claims, 9 Drawing Sheets

ROTATION CONNECTOR AND A METHOD OF MAKING THE SAME

BACKGROUND OF THE INVENTION

1. Field of the Invention

The present invention relates to a rotation connector adapted to the transmission of electrical signals from a first device to a second device, which second device is rotatable with respect to the first device. The rotation connector includes a substantially dielectric support member having a longitudinal direction and provided with a first end portion and a second end, wherein the support member comprises an electrically conductive track extending in the longitudinal direction as far as the region of the second end portion, a self-supporting contact ring having a substantially circular electrically conductive peripheral edge and an inner edge defining a recess around the center-line of the contact ring, said contact ring being fixed on the support member. The recess substantially encloses the support member in such a manner that the center-line of the contact ring is substantially parallel to the longitudinal direction of the support member. The peripheral edge of the contact ring is connected to the track via an electrically conductive path. The present invention also relates to a contact ring, an insulator element, and a support member for use in such a rotation connector. In addition, the invention relates to a method of making the rotation connector.

2. Related Art

A connector of this kind, which is also known as a slip ring, is known from the prior art. FIG. 1 is a diagram of a rotation connector of this kind. This connector is made as follows: In a first step, an electrically conductive wire provided with an insulating coating is soldered or spot-welded to the inner edge of a (frequently) brass contact ring. As many contact rings as are necessary for the type of connector can be made in this way. A first contact ring is then placed in a jig. A second contact ring is then pushed over the wire fixed to the first contact ring and the second contact ring is placed close to the first contact ring so that they do not make contact with one another. A third contact ring is then pushed over the two wires of the first and second contact rings, and this third ring is pushed close to the second contact ring, again without making contact. A row of contact rings is built up in this way. The row is then embedded, possibly via an injection moulding process, in a dielectric plastic which after cooling and/or chemical hardening forms a rigid support member for the contact rings. As a result, the contact rings are permanently fixed and insulated from one another in the connector. In addition, the wires which serve as electrically conductive tracks from the respective contact rings to the second end of the rotation connector, are rigidly fixed in the plastic on the inside of the support member. The next step is to turn the injection moulding in a lathe so that the conductive cylindrical surface of the contact rings is exposed. Finally the connector is provided on the outside of the contact rings with a brush which includes a plurality of individual brush elements as there are contact rings in the connector. The brush provides the electrical contact between the contact rings and the surroundings of the connector. In this way conductive connections can be made between the brush and the wires which emerge at the second end of the rotation connector.

The connector is used by connecting the brush to a first device and by connecting the wires emerging from the connector near the second end portion to a second device which can rotate with respect to the first device. With this construction of the connector, the electrical contact between the two devices is maintained even when the second device rotates with respect to the first device.

The known rotation connector, however, has a number of significant disadvantages. Above all, the assembly of this known connector involves a very labor-intensive process. Thus placing the contact rings over the wires of the preceding rings cannot be automated, so that this operation requires considerable expensive working time. In addition, during the moulding of the plastic support member, there is a considerable risk that one or more of the wires on the inside of the contact rings will work loose, because the soldered or spot-welded connection is mechanically weak. Also, after the moulding of the plastic support member, each connector must be individually finished on a lathe. Not only is this also a labor-intensive operation, but it also increases the risk of defects, for example a complete breakage of the connector or breakage of the emerging wires, in the connector which has already been largely assembled. Such defects, e.g., the working loose of a soldered connection as described above, cannot be remedied after the support member has been moulded. This means that the production costs due to rejects of practically completely assembled connectors become even more expensive. Another significant disadvantage is that the wires extend substantially through the center of the support member. In this way it is difficult, particularly in the case of small connectors, to combine the same with other forms of signal transmission for which space is required in the connector. Thus, in modern communications technology, signal transmission is frequently effected by optical fibers, which can hardly be accommodated, if at all, in the support member, because there is practically no room for them, while on the other hand the support member is not sufficiently transparent for direct transmission of optical signals, due to the presence of the wires. Even for other more conventional signal transmission, such as capacitative and inductive transmission, the known connector is unsuitable because components would have to be accommodated in the core of the support member for this purpose. Although that is not completely impossible, it would result in connectors which are difficult to miniaturize, if they can be miniaturized at all.

SUMMARY OF THE INVENTION

The object of the present invention is to provide a rotation connector which is simple to assemble and which is adapted to being combined with a second form of signal transmission. To this end, a rotation connector according to the preamble of claim 1 has been developed, wherein the track is disposed on the surface of the support member. The connector according to the present invention is made by providing the surface of the support member with at least one conductive tracks, for example in the form of a thin metal layer. The contact ring is then pushed over the support member in such manner that it makes electrically conductive contact with the track. A second contact ring can then be pushed over the support member in the direction of the first, and this contact ring makes contact with a second track. In this way, the connector can be constructed very simply and by automatically. Any defects, for example a non-functioning contact ring, can easily be remedied by removing such contact ring from the connector and replacing it by another. A defect in a track, for example a break, where no electrically conductive through the connection is achieved, can also easily be remedied by removing the contact ring or rings from the connector and repairing the track. Also, the construction of the connector according to the present invention enables the support member to be made hollow so that other components can be accommodated in the cavity, for example, a means for the optical transmission of data from the first device to the second device.

In one embodiment, the track is formed as a first profile in the surface of the support member and, the inner edge of the contact ring is provided with a second profile which is in operative connection with the first profile. This embodiment offers the advantage that the assembly of the connector is further simplified because it is then possible to form the contact ring in such a manner that it can be pushed on the support member in only one way with the conductive contact being, at all times, formed via the co-operating profiles. It also offers the possibility of arranging that any following contact ring will always be in electrically conductive connection with a subsequent track by ensuring that each subsequent contact ring is pushed with its profile over a following track.

In one preferred embodiment, the first profile is a recess in the said surface and the second profile is a projection on the inner edge of the contact ring. This embodiment has the advantage that the various parts, and particularly the support member, can be made in very simple manner, for example by injection mouldings. The support member, which is made substantially from an electrically insulating material, e.g. a dielectric plastic, can also be provided with channels in the longitudinal direction by a machining operation, for example milling. By finishing on a lathe a substantially circular peripheral edge can thus be formed in a simple manner.

In one embodiment, the contact ring is connected to the said track under pressure at the electrical transition between the contact ring and the track. This embodiment, in which the projection on the inner edge of the contact ring is held under pressure against the corresponding track, formed as a channel, offers the advantage that the electrical transition between the contact ring and the track is reliable. In addition, good mechanical anchoring of the contact ring on the support member is obtained in this way so that the connector is operationally more reliable.

In a preferred embodiment, the contact ring is so shaped that the projection on the inner edge is resiliently displaceable with respect to the contact ring. For example, by providing a recess in the contact ring close to the location where the projection is situated, on the inner edge, it is possible, without using additional means, for the projection to spring with respect to the contact ring. This can be utilised in order to place the projection under pressure in the track formed as a channel. An additional advantage is that the mechanical anchoring of the contact ring on the support member is further improved.

In one embodiment, the contact ring is removably fixed on the support member. This embodiment has the advantage that the rotation connector can, at all times, be repaired and a more flexible system is also obtained.

In another embodiment, the contact ring is a plastic product provided with a conductive coating, said coating comprising at least a part of the conductive path. This embodiment offers a number of significant advantages. Firstly, a contact ring according to this embodiment can be produced very simply, for example by injection moulding of a suitable plastic in a jig and then providing the ring with a conductive coating. This can be effected in a manner sufficiently known from the prior art to one skilled in the art, for example, by vapor coating of a metallic layer, or by application of a conductive plastic from a solution, or electroplating a metallic layer in a bath suitable for the purpose, etc. A contact ring of this kind can easily be obtained in any desired shape. On the one hand the conductive coating ensures a conductive peripheral edge while on the other hand it forms part of the conductive path from said peripheral edge to the projection on the inner edge. The result is a reliable electrical connection between the peripheral edge and the conductive track on the support member.

In one embodiment, the peripheral edge is provided with a substantially continuous groove in the tangential direction. A groove of this kind is used to accommodate the conductive element of a brush, for example a wire, or a bunch of wires (in the tangential direction). As a result this wire will not lose contact with the peripheral edge because the walls of the groove hold the wire in the middle of the contact ring. Also, the contact surface with the wire of the brush and the peripheral edge is larger than if the peripheral edge is constructed as a flat edge. In one preferred embodiment, wherein the connector also comprises an electrically conductive brush which is in contact with the peripheral edge of the contact ring, the groove is in communication with two brushes. By connecting the groove with two brushes, an operationally more reliable connector is obtained because the risk of two brushes breaking down simultaneously is many times reduced. Although provision of a second brush means that the production costs for the connector are increased, such increase is minimal. In addition, this is compensated as far as the connector user is concerned by a more reliable connector, which consequently has to be replaced or repaired much less frequently.

The advantages of the present invention can be utilised particularly if the rotation connector is provided with at least two conductive mutually insulated tracks, and the rotation connector also comprises at least two contact rings corresponding to these tracks, each contact ring being in electrically conductive connection with one track and the contact rings being fixed on the support members so as to be insulated from one another. The production of a connector of this kind, in particular, will require much less time and particularly less labor, than the known connector. In one preferred embodiment, the contact rings are of substantially the same shape. This means a further simplification of the product and hence a further reduction of the costs.

In another embodiment, the rotation connector is also provided with insulator elements disposed between the two contact rings. By means of a ring of this kind, it is a simple matter to fix two contact rings on the support member so that they are insulated from one another. These insulator elements also, for example constructed as substantially annular self-supporting elements having a recess corresponding to that of the contact rings, can also be made in the same shape so that the number of different elements from which the connector is constructed is limited.

In a further preferred embodiment, the insulator element is provided with a third profile in co-operating connection with the first profile in the form of tracks. An insulator element of this kind, the inner edge of which is thus provided with, for example, projections which are substantially of the same shape as the cross-section of each of the tracks, can thus be easily mechanically fixed on the support member. By making a co-operating connection between the insulator element and at least one contact ring, there is good mutual fixing of the contact ring and the insulator element. This has the great advantage that the function of the mechanical fixing of the contact rings and insulator elements on the support member can be practically completely stopped in the form of the insulator elements. In this way, the functions for fixing and electrical conduction can be further separated, thus making the product more tolerant, because each of the components has to combine less functions in itself.

In one embodiment, the region of the first end of the rotation connector is provided with a flange to support the set of contact rings and insulator elements on the support member, and the second end is adapted to provide a plug comprising at least two connecting elements for the electrical connection of the tracks to the said second device. The said flange makes the production of the rotation connector even simpler, because the first contact ring or the first insulator element can simply be pushed against the flange so that said first element is fixed at a distinct location. Subsequent contact rings and insulator elements will then arrive at a distinct location as if of themselves. In this preferred embodiment, the second end is provided with the facility for fitting a plug for connecting the second device, said plug normally having as many connecting or contact elements as there are tracks on the support member, each connecting element corresponding to a track. It is also possible to construct a connecting element that makes contact with two or more tracks simultaneously. This embodiment is advantageous if heavier currents are required. In this way, the current flowing through a number of tracks can be collected and this has the advantage that each of the tracks does not of itself have to be made more rugged.

In a further preferred embodiment, the connecting elements are in contact with the corresponding tracks under pressure. This improves the electrical transition from the track to the plug. A pressure of this kind can be created, for example, by making the connecting elements in the form of thick wires which are convex in the region of the track in the direction of the latter, so that they can form a good point contact under pressure.

In one preferred embodiment, the rotation connector is provided with a continuous cavity from the first end portion to the second end portion, the cavity being provided with a means for transmitting signals. The rotation connector according to the present invention enables the transmission of electrical signals via the connector itself to be easily combined with the transmission of subsequent signals. This combination has the important advantage that there is no need for a plurality of communication lines between the first and second device and yet the transport of all kinds of signals can be combined in one connector. This means a considerable saving of costs and gives greater freedom for the design of systems in which a combination of this kind is necessary. A connector combined in this way can be used, for example, for high grade applications where it is necessary to provide a rotatable device with electrical signals and other signals, particularly data. Such applications are found in particular in information and communication technology, for example in surveillance cameras, digital printers, aircraft, guided missiles, and so on.

In one particular embodiment, the said means for transmitting signals is a transparent medium for transporting optical signals. A medium of this kind enables data to be transported through the connector at very high speed. Examples of printers in which a rotation connector according to the present invention, and particularly according to the embodiment combined with a high speed data link, can be used are described in U.S. Pat. Nos. 4,704,621 and 5,742,320 and European Patent Application EP 0 991 259.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
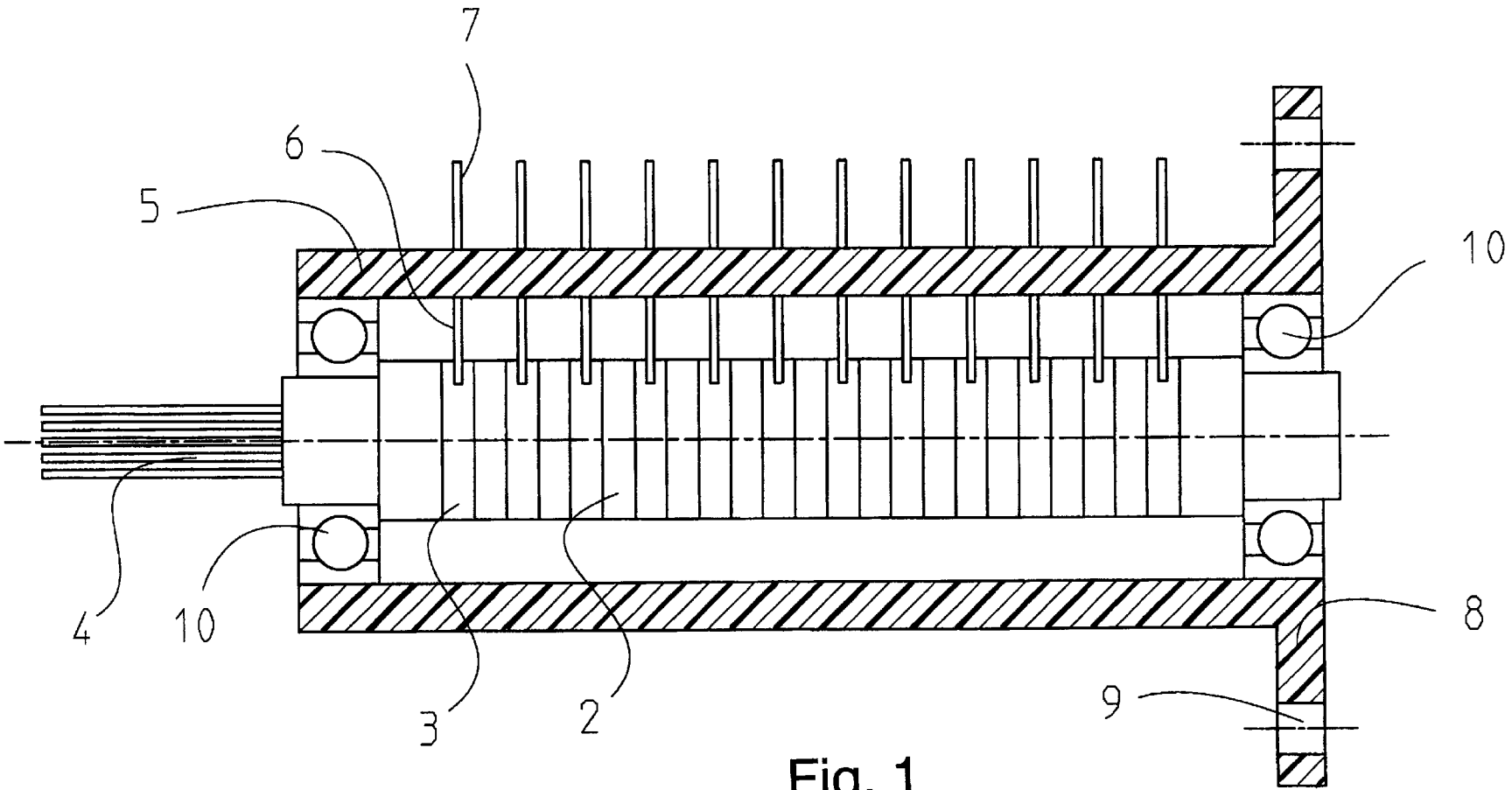
FIG. 1 is a rotation connector as known from the prior art.

FIG. 1 is a diagram of a rotation connector as known from the prior art. A rotation connector 1 of this kind is constructed from a support member 2, in this case a moulded dielectric plastic, provided with a number of brass contact rings 3. The contact rings are insulated from one another and embedded in the plastic support member as a result of the method of production as indicated hereinabove. A number of wires 4 extends through the support member, each making contact with one of the contact rings. These wires are also embedded in the support member. The support member 2 is rotatably connected to a flange 8 via a ball bearing 10. The flange 8 is provided with holes 9 to fix the connector to a supporting wall.

In this case, the connector is conductively connected to a brush 5 forming part of a housing enclosing the support member. The brush 5 is provided with a number of brush elements 6, in this case thick wires of a conductive copper alloy. Each of these wires is in turn conductively connected to one of the wires 7 at the other end of the brush. In this way, each of the wires 7 is ultimately electrically connected to each of the wires 4. As a result of the rotating suspension of the support member on the flange 8, the wires 4 can be connected to a device which rotates with respect to the brush 5, without the electric contact between the brush and the device being lost. In this way it is possible reliably provide rotating devices with electrical signals.

Figure 2:
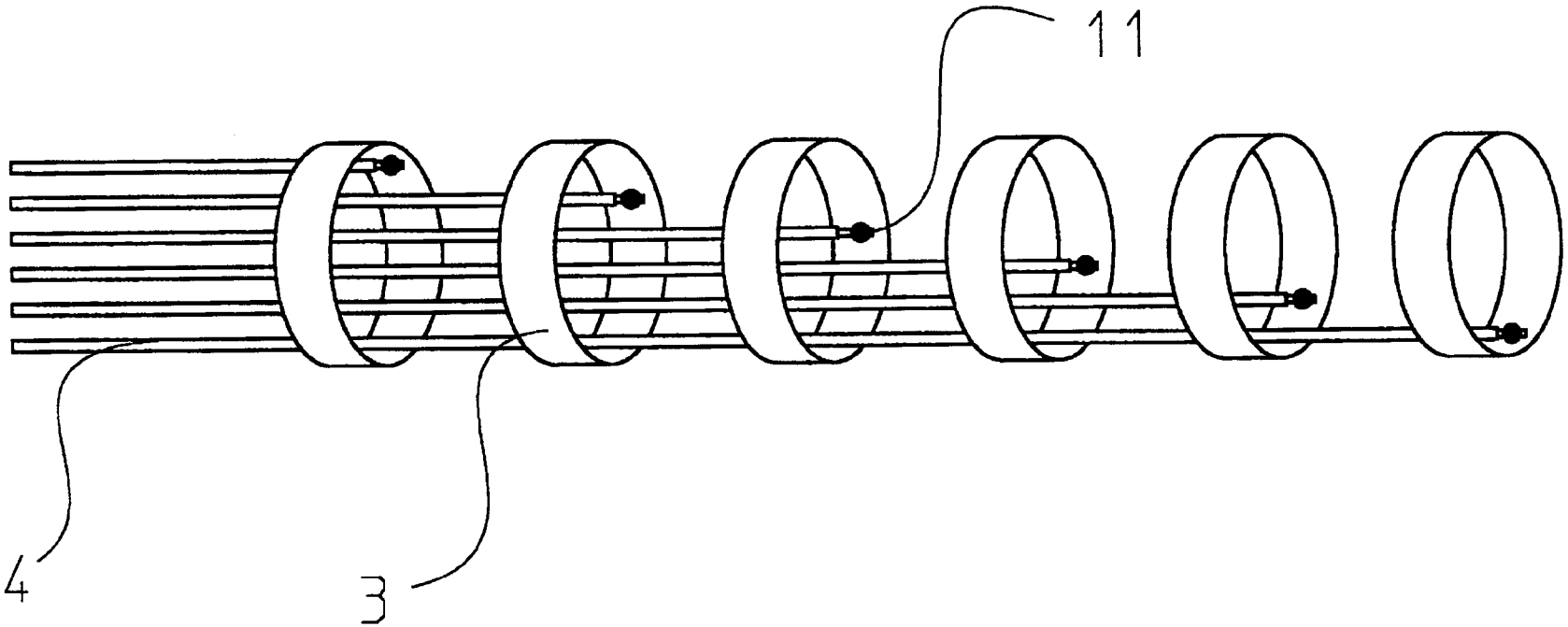
FIG. 2 is a detail of the known rotation connector.

FIG. 2 is a detail showing a number of contact rings 3 and the associated wires 4 of the known rotation connector. It is clear from this Figure how a connector of this kind is constructed. Each of the wires, except for the wire connected to the contact ring on the far left, extends from the contact ring on the far left through one or more of the other contact rings until the wire reaches the contact ring with which an electrically conductive connection is to be formed. This connection 11 is achieved by soldering the wire to the associated contact ring.

It is not only the fixing of the wires to the contact rings that is a relatively expensive and unreliable process, but in particular, the mounting of the contact rings in the manner indicated, each ring having to be pushed over a bunch of wires, which is a very labor-intensive process.

Figure 3:
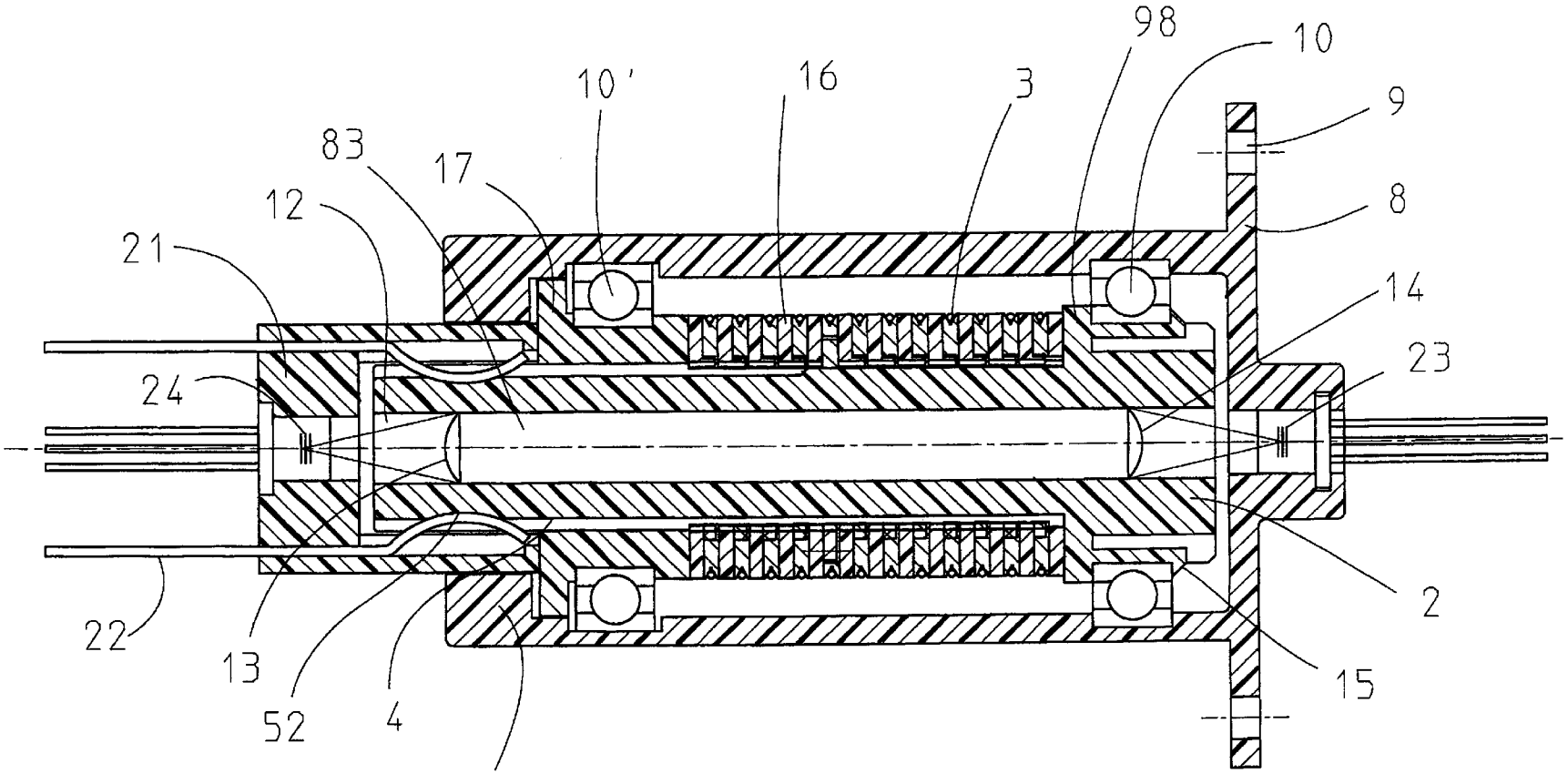
FIG. 3 is a diagram in cross-section of a rotation connector according to the present invention.

FIG. 3 diagrammatically illustrates in cross-section one example of a rotation connector according to the present invention. This rotation connector is constructed around a support member 2 provided with a continuous cavity 12 containing a cylindrical lens 83 provided with aspherical lens faces 13 and 14. At the right-hand end, the support member 2 is provided with a flange 98. This flange also carries the ball bearing 10 via a support profile 15. In this embodiment, the support member is provided with twelve contact rings 3, each insulated from one another by insulator elements 16. In this embodiment, each contact ring 3 is electrically, conductively connected to one track 4 (for example, more than one contact ring can be used per track for the transmission of heavier currents). The row of contact rings 3 and insulator elements 16 are limited by the end flange 17 at the left-hand end of the support member, but the end flange 17 does not form an integral part of the support member but, like the contact rings 3 and insulator elements 16, is pushed onto the support member. The end flange 17 carries a second ball bearing 10'.

The above-described construction is enclosed by the housing 20, constructed from two identical halves. For the connection of the rotation connector to a rotating device, the left-hand end of the connector is provided with a plug 21 which has connecting elements 22. Each of the connecting elements is provided with a convex end 52, whereby contact is made with the conductive tracks 4 disposed on the surface of the support member 2. In this cross-section only two connecting elements are visible. However, in this embodiment the plug comprises the same number of connecting elements 22 as there are contact rings 3 in the connector itself. The rotation connector of this example is also connected to an electro-optical transmitter 23 and an electro-optical receiver 24 for transmitting optical signals. In this way, this rotation connector is also suitable as a high speed data link.

Figure 4:
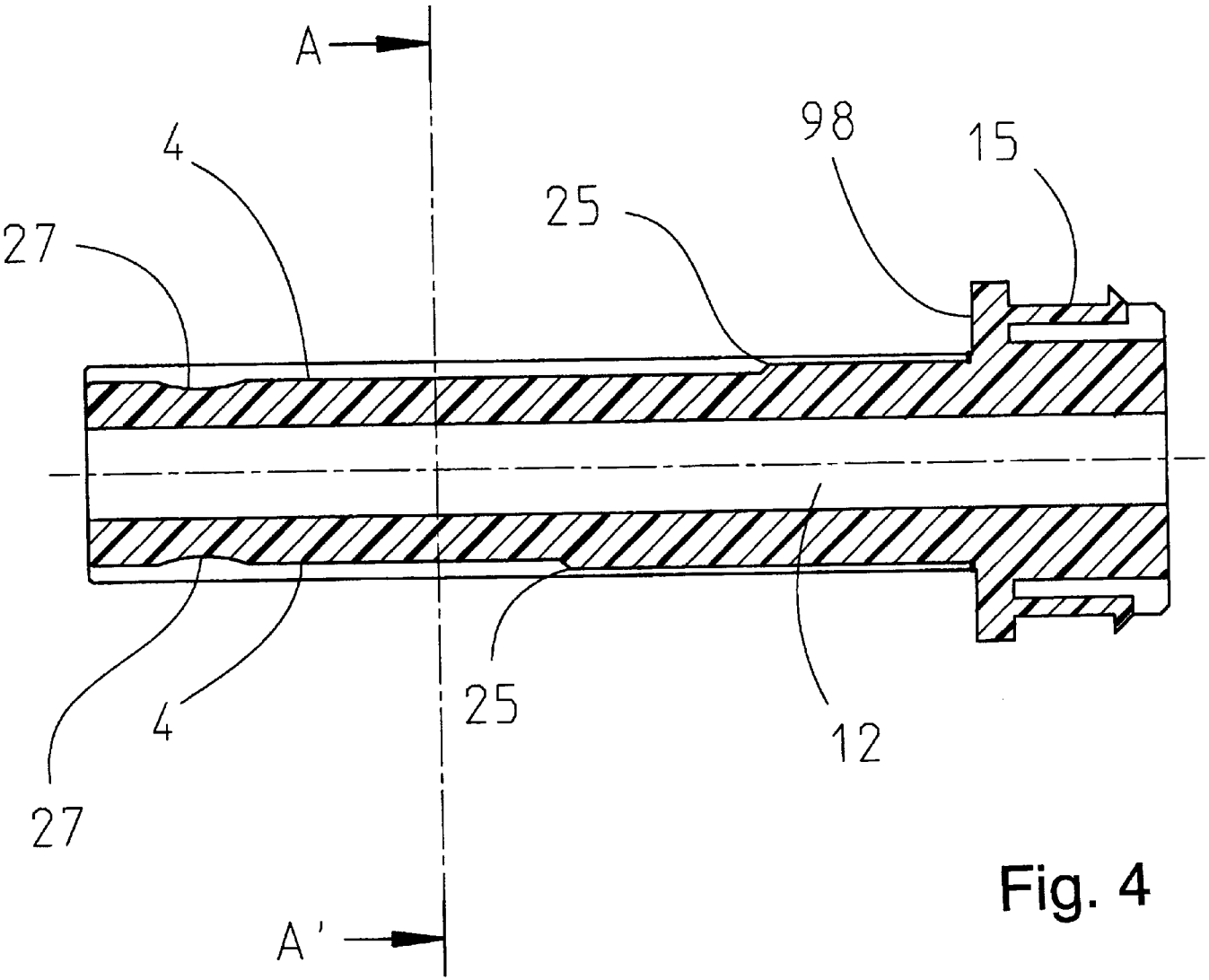
FIG. 4 is an illustration of a support member of the rotation connector as shown in FIG. 3.

FIG. 4 illustrates the support member 2 of the rotation connector as shown in FIG. 3. Two tracks 4 are visible in this cross-section. Each of the tracks starts at the left-hand end of the support member and extends as far as the flange 98 near the right-hand end of the support member 2. It will be seen that each of the tracks has a kink at a specific location 25, such that the track is situated further away from the center-line of the support member 2.

The reason for this kink is as follows: the contact rings 3 and insulator elements 16 are pushed over the support member 2 in the direction of the flange 98. By placing the tracks 4 initially at a deeper level, these elements can easily be pushed over the support member because the fit is (much too) ample. This prevents the conductive tracks from being damaged too much during assembly of the rotation connector. As soon as a contact ring 3 reaches the kink 25 in the track with which electrical contact is to be made, the fit becomes very tight and the contact ring 3 can be fixed with a clamping action on the support member 2. This results in good contact between the contact ring 3 and the track 4. Since the support member 2 in the rotation connector according to this example is constructed as an injection moulding, a shape of this kind has little effect on an increase in production costs. At the left-hand end, the support member is also provided with recesses 27 which correspond to convex parts 52 of the connecting elements 22. In this way, a rigid click connection was formed between the plug 21 and the support member 2.

In this embodiment, the support member is made from an electrically insulating plastic. It is possible, however, to make the support member from an electrically conductive material, for example aluminium, having at the surface an electrically insulating layer sufficiently thick to enable tracks to be accommodated which are electrically insulated from one another. In this alternative method, therefore, a support member can be formed which, in essence, is a dielectric, i.e. in the neighborhood of the tracks.

Figure 5:
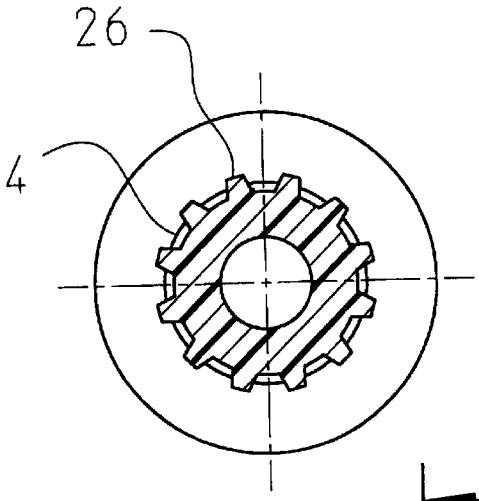
FIG. 5 is a cross-section through the support member taken along line A-A' in FIG. 4.

FIG. 5 is a cross-section of the support member 2 taken along line A-A' in FIG. 4. In this cross-section the twelve tracks 4 are visible, and formed as recesses (channels) in the surface of the support member 2. These recesses, which are separated by embankments 26, are provided with a good retention coating in order to make the tracks conductive. In this case the coating is applied by electroplating. During this process, however, the entire outside of the shank of the support member is provided with a conductive coating so that each track is in conductive connection with each of the other tracks. By simple machining on a lathe, namely turning off a thin layer of the shank of the support member 2, twelve individual conductive tracks 4 are obtained. The number of tracks is very dependent on the use of the connector. The maximum number of tracks for a specific diameter of the support member will be determined by the required contact area between the track and the contact ring, and this contact area also determines the resistance of the electrical contact. Those skilled in the art can determine the size required for the contact surface for the required application, in manners sufficiently known from the prior art.

Figure 6A:
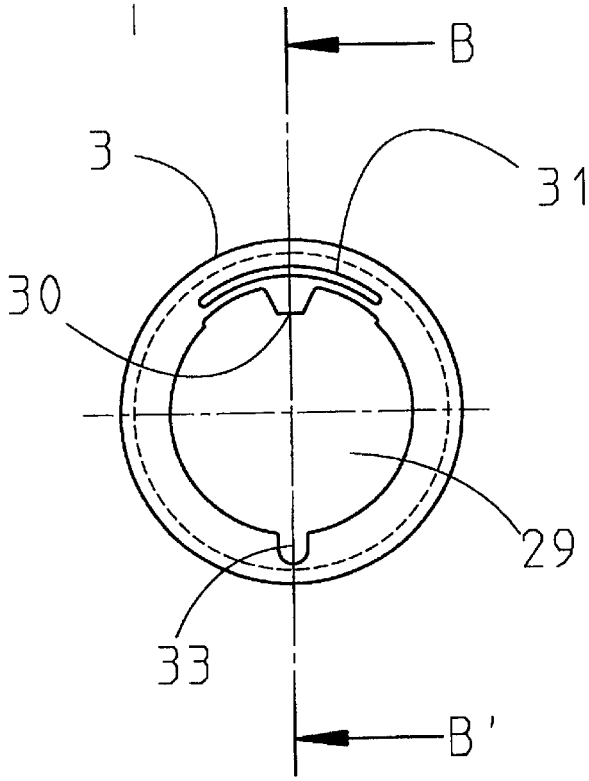
FIGS. 6A and 6B, diagrammatically illustrate a contact ring according to the present invention.
Figure 6B:
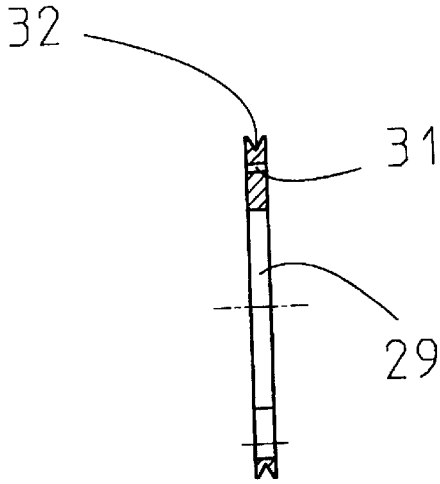

FIGS. 6A and 6B, diagrammatically illustrate the contact ring according to the present invention. FIG. 6A is a view of a contact ring 3. FIG. 6B is a cross-sectional view of the contact ring taken along line B-B' in FIG. 6A.

The contact ring 3 is provided with recess 29, which corresponds substantially to the outside diameter of the shank of the support member 2. A projection 30 is provided on the inner edge of this recess and its shape corresponds to a track 4 constructed as a recess in the support member 2. Just above the projection 30 the contact ring is provided with a second recess 31 so that the projection 30 can spring with respect to the contact ring itself. This enables the contact ring to be fixed under pressure on the support member, the pressure being largely transmitted via the contact between the projection 30 and the track 4 so that in addition to a mechanical connection between the contact ring and the support member there is also a good electrical contact between the projection 30 and the track 4. The peripheral edge of the contact ring is provided with a groove 32 to receive a brush element. The electrical path from the groove 32 to the projection 30 is provided by a conductive coating in the contact ring, which is an injection moulding of a substantially electrically insulating plastic, the said coating being applied to the surface of the contact ring. Finally, the contact ring is provided with a third recess 33, which serves to receive a projecting part of an insulator element 16 (shown in FIG. 7) for positioning and mutual anchoring elements 3 and 16.

Figure 7A:
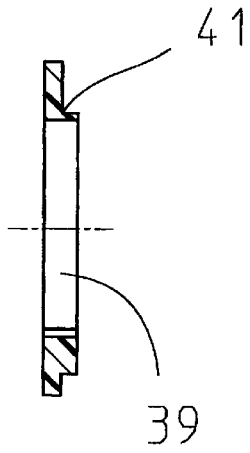
FIGS. 7A and 7B, diagrammatically illustrate an insulator element according to the present invention.
Figure 7B:
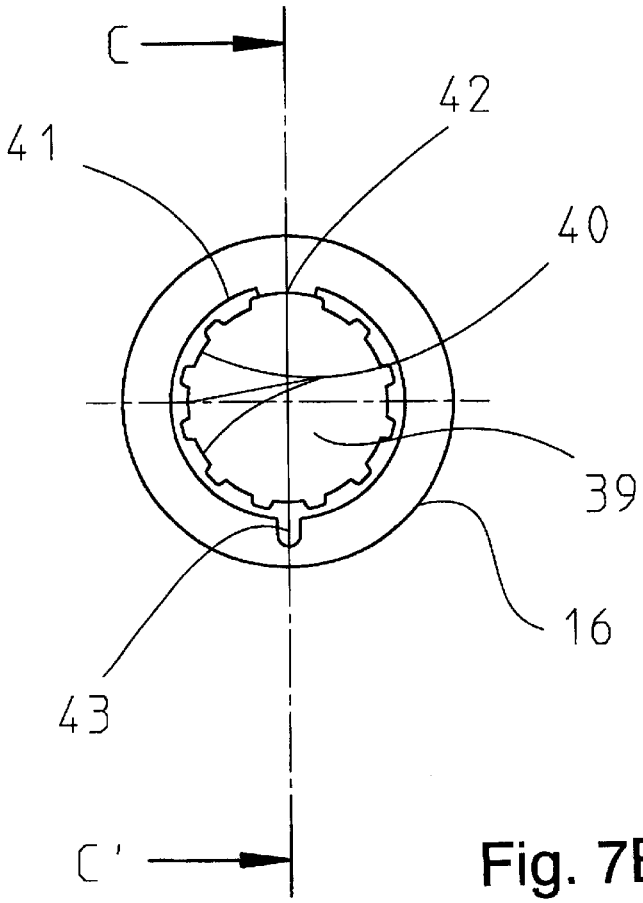

FIGS. 7A and 7B, diagrammatically illustrate an insulator element according to the present invention. FIG. 7A is a section of an insulator element 16 taken along line C—C' as shown in FIG. 7B. FIG. 7B is an elevation of the insulator element 16. The insulator element 16 is provided with a centering edge 41, which has an external shape corresponding basically to recess 29 of contact ring 3. The contact ring 3 can be fixed on this centering edge 41 by a press fit. The insulator element is provided with a recess 39 which corresponds basically to the outside diameter of the shank of the support member 2. The inner edge around the recess of the insulator element 16 is provided with a recess 42 in which the projection 30 of the contact ring can be received. The insulator element is also provided with a projection 43 which fits in the recess 33 in the contact ring 3. The inner edge of the insulator element 16 is provided with a number of projections 40 (eleven in this case), which correspond to each of the tracks with which the corresponding contact ring does not make electrically conductive contact. These projections, which are not as high as projection 30 on the contact ring, serve to anchor the insulator element, and hence also the contact ring, on the support member. The insulator element is constructed as an injection moulding from a substantially electrically insulating plastic.

Figure 8:
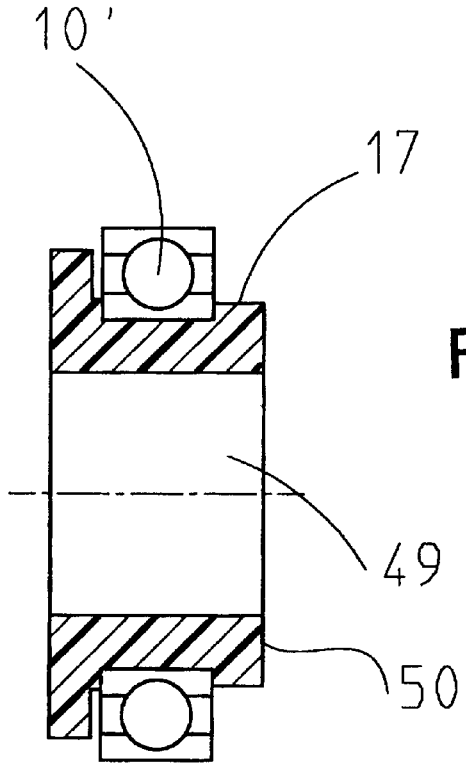
FIG. 8 is a diagram showing the removable flange of the connector as shown in FIG. 3.

FIG. 8 is a diagram showing the removable flange of the connector as illustrated in FIG. 3. The flange 17 is provided with a recess 49 corresponding basically to the outside diameter of the shank of the support member 2. The recess is so shaped that a connection is achieved between the flange and the support member on the basis of mutual frictional forces. The flange is provided with a projecting part 50 which supports and encloses the ball bearing 10'.

Figure 9:
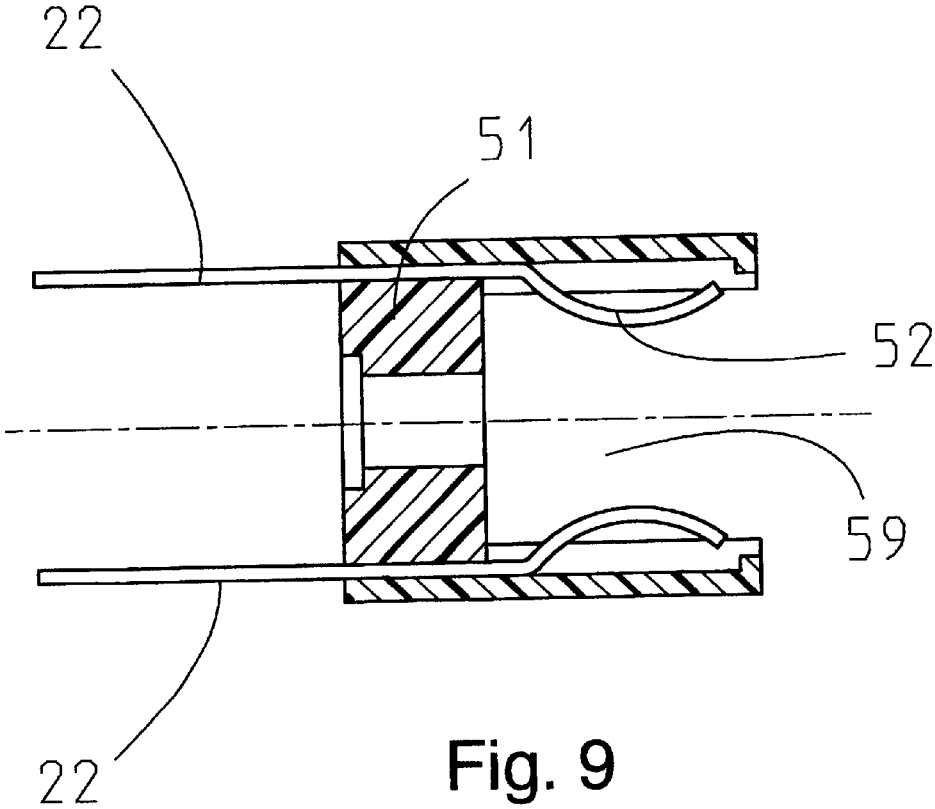
FIG. 9 is a diagram showing the plug of the rotation connector according to the present invention.

FIG. 9 diagrammatically shows the plug of the rotation connector according to the present invention. The plug is constructed from an electrically insulated housing 51 provided with connecting elements 22. The latter terminate on the connector side in concave parts 52 which project into recess 59. This recess corresponds basically to the outside diameter of the shank of the support member 2. Each of the connecting elements 22 is electrically, conductively in contact with a track 4 of the support member via the concave part 52. As a result of the concave shape, this contact is formed under pressure. This ensures a rigid connection of the plug to the connector. The plug is also provided with the recess 59 so that data can be optically transmitted.

Figure 10:
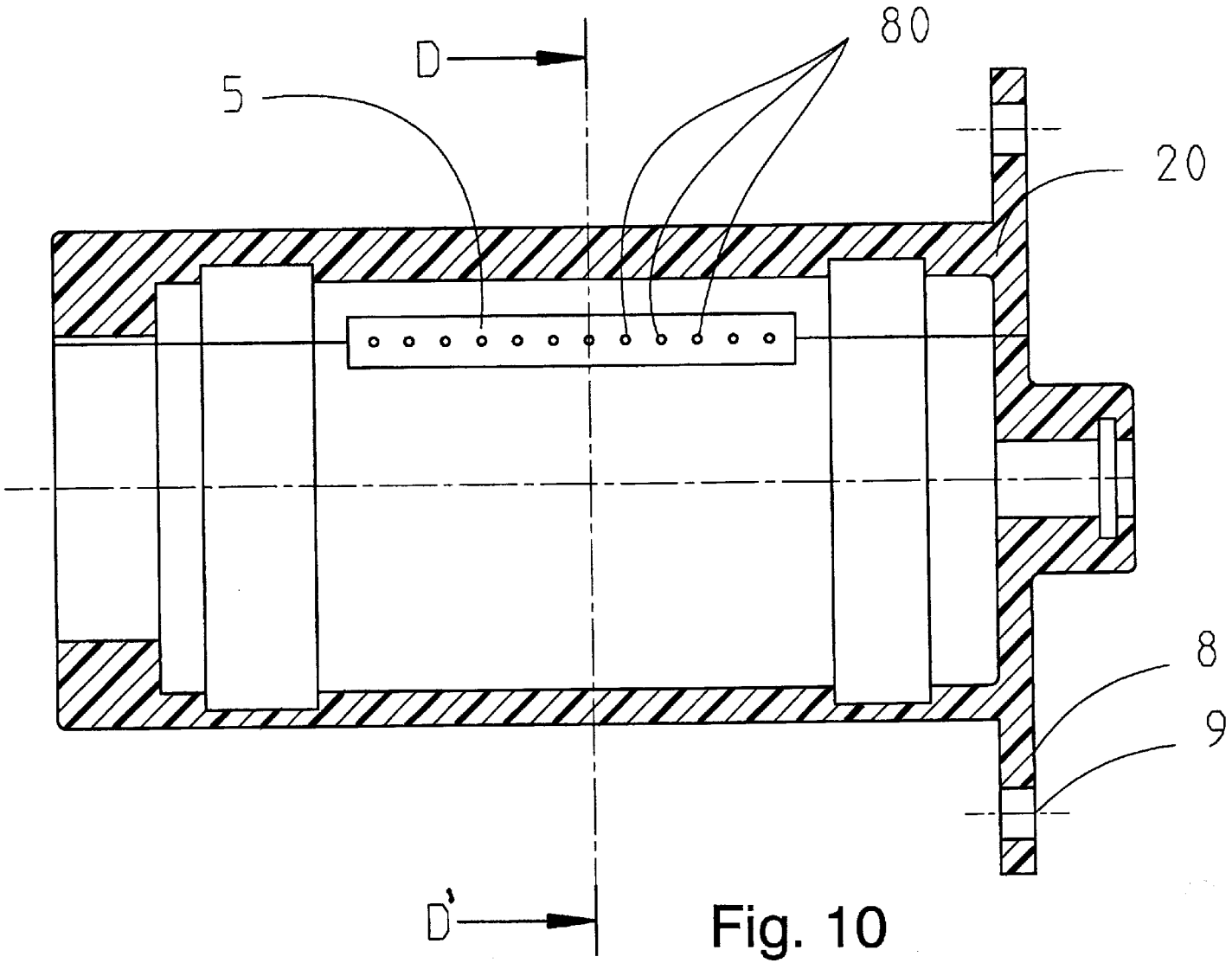
FIG. 10 shows the housing of the rotation connector.

FIG. 10 is a side elevation of the housing 20 of the rotation connector. In this rotation connector, the electrically conductive housing 20 is constructed from two identical parts which form a click connection near the center-line of the housing. Both parts of this housing are formed by an injection moulding process. The outside of the housing 20 is provided with a brush 5, which is provided with twelve passages 80, corresponding to the twelve contact rings of the rotation connector.

Figure 11:
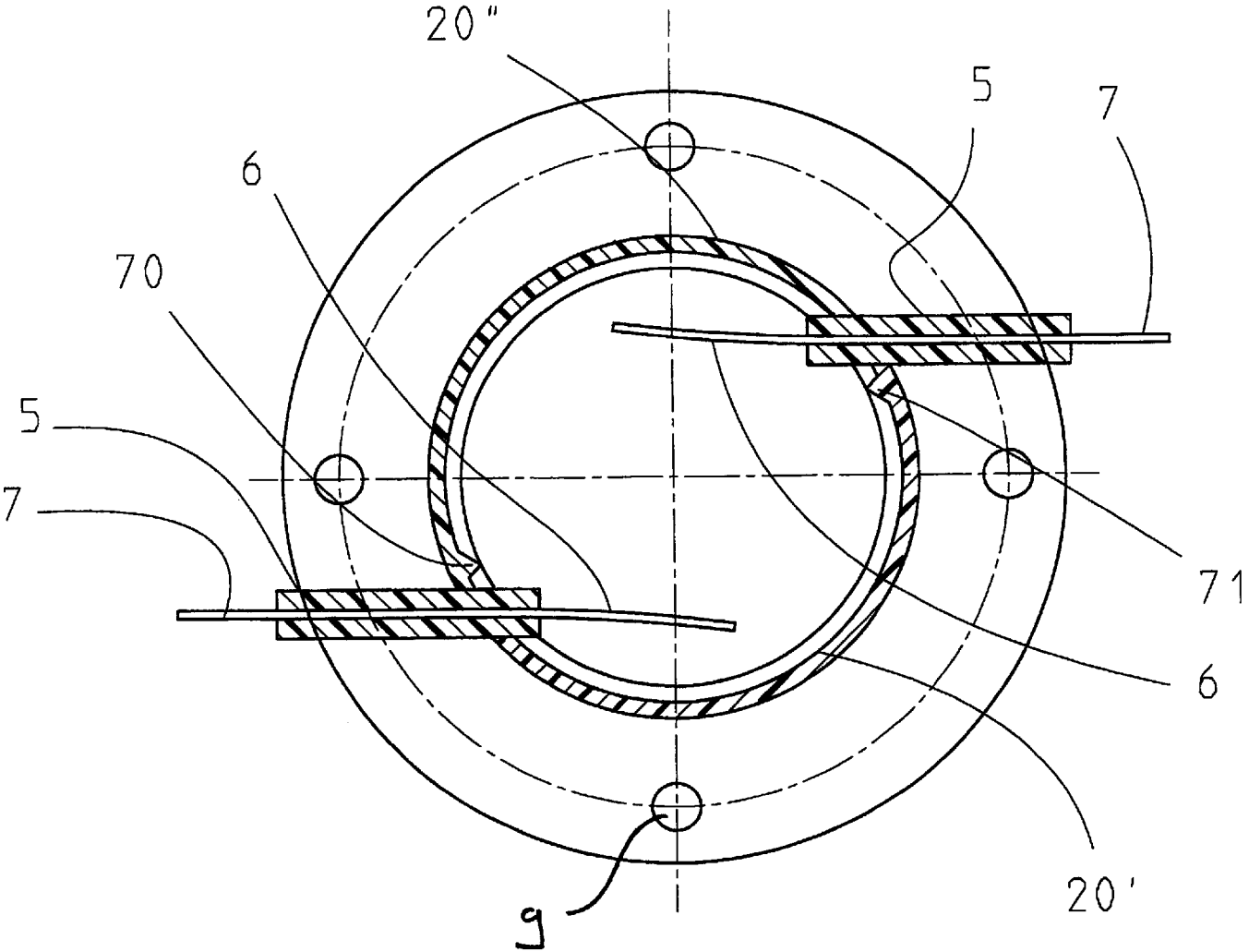
FIG. 11 is a cross-section of the housing shown in FIG. 10 taken along line D-D'.

FIG. 11 is a cross-section through the housing as shown in FIG. 10 taken along line D-D'. It will be seen from FIG. 11 that the housing 20 is constructed from two identical parts 20' and 20", which are interconnected by a click connection at the locations 70 and 71. In this case the housing is provided with two brushes 5 which on the inside of the housing terminate in brush elements 6 in contact with the groove 32 of one of the contact rings 3. On the outside, the brush terminates in wires 7 which are used to make electrical contact with the connector surroundings.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rotation connector adapted to the transmission of electrical signals from a first device to a second device, which second device is rotatable with respect to the first device, which comprises:

a substantially dielectric support member having a longitudinal direction and provided with a first end portion and a second end portion, said dielectric support member having an electrically conductive track extending in the longitudinal direction as far as the region of the second end portion and provided with a continuous cavity from the first end portion to the second end portion, the cavity being provided with a means for transmitting signals, a self-supporting contact ring having an electrically conductive peripheral edge and an inner edge defining a recess around the center-line of the contact ring, said contact ring being fixed on the support member, said recess substantially enclosing the support member in such a manner that the center-line of the contact ring is substantially parallel to the longitudinal direction of the support member, the peripheral edge of the contact ring being connected to the electrically conductive track via an electrically conductive path, wherein the electrically conductive track is disposed on the surface of the support member.

2. The rotation connector according to claim 1, wherein the electrically conductive track is formed as a first profile in the surface of the support member, the inner edge of the contact ring being provided with a second profile which is in operative connection with the first profile.

3. The rotation connector according to claim 2, wherein the first profile is a recess in the said surface of the support member and the second profile is a projection on the inner edge thereof.

4. The rotation connector according to claim 1, wherein the contact ring is connected to the electrically conductive track under pressure at the electrical transition between the contact ring and the electrically conductive track.

5. The rotation connector according to claim 4, wherein the contact ring has a projection on the inner ring at said electrical transition, said projection being in operative connection with the electrically conductive track, which is constructed as a recess, wherein the contact ring is shaped such that the projection on the inner edge is resiliently displaceable with respect to the contact ring.

6. The rotation connector according to claim 1, wherein the contact rings are removably fixed on the support member.

7. The rotation connector according to claim 1, wherein the contact ring is a plastic product provided with a conductive coating which provides at least a part of the conductive path.

8. A rotation connector according to claim 1, wherein the peripheral edge is tangentially provided with a substantially continuous groove.

9. The rotation connector according to claim 8, wherein the connector comprises an electrically conductive brush which is in contact with the peripheral edge of the contact ring, wherein the groove is in communication with two brushes.

10. The rotation connector according to claim 1, wherein the means for transmitting signals comprises a transparent medium for transporting optical signals.

11. The rotation connector according to claim 1, wherein the support member is provided in the longitudinal direction with at least two conductive, mutually insulated tracks, and the rotation connector further includes at least two contact rings corresponding to these tracks, each contact ring being in electrically conductive connection with one track and the contact rings being fixed on the support member so as to be insulated from one another.

12. The rotation connector according to claim 11, wherein the contact rings are substantially of the same shape.

13. The rotation connector according to claim 11, wherein the rotation connector is further provided with insulator elements disposed between the two contact rings.

14. The rotation connector according to claim 13, wherein the tracks are constructed as a first profile, wherein the insulator element is provided with a third profile in operative connection with the first profile for the fixing of the insulator element on the support member, and wherein the insulator element is in operative connection with the contact ring for the mutual fixing of the contact ring and the insulator element.

15. The rotation connector according to claim 11, wherein the first end portion is provided with a flange to support the contact rings and insulator elements on the support member, and wherein the second end portion is adapted to be provided with a plug which contains at least two connecting elements for the electrical connection of each of the electrically conductive tracks to the said second device.

16. The rotation connector according to claim 15, wherein the connecting elements are in pressure contact with the corresponding electrically conductive tracks.

17. A method of making a rotation connector which comprises:

providing a substantially dielectric support member having a longitudinal direction and provided with a first end portion and a second end portion, the support member being provided on its surface with at least two longitudinally extending, electrically conductive tracks, said electrically conductive tracks being made by forming the support member as an injection moulding provided with at least two recesses in the longitudinal direction on its surface, whereafter the support member is provided with an electrically coating, at lest at the recesses, and whereafter the outer surface of the coated support member is machined in such a manner that the coating is removed between the recesses so that the recesses are electrically insulated from one another, providing self-supporting first and second contact rings with a substantially circular and electrically conductive peripheral edge, said contact ring being further provided with a recess around its center-line to receive the support member, fixing the first and second contact ring on the support member by accommodating the support member in the recess in such a manner that the support member is substantially enclosed by the recess, the said center-line extending substantially parallel to the longitudinal direction of the support member, wherein during said fixing, an electrical connection is formed with the conductive tracks such that the peripheral edge of the contact ring is conductively connected to the said tracks, whereafter the support member is provided with a plug near the second end portion, said plug having at least two connecting elements which are in contact with the respective tracks, and mounting an electrically conductive brush to be in conductive contact with the peripheral edge of the contact rings.

18. A rotation connector adapted to the transmission of electrical signals from a first device to a second device, which second device is rotatable with respect to the first device, which comprises:

a substantially dielectric support member having a longitudinal direction and provided with a first end portion and a second end portion, said dielectric support member having an electrically conductive track extending in the longitudinal direction as far as the region of the second end portion, a self-supporting contact ring having an electrically conductive peripheral edge and an inner edge defining a recess around the center-line of the contact ring, said contact ring being fixed on the support member, said recess substantially enclosing the support member in such a manner that the center-line of the contact ring is substantially parallel to the longitudinal direction of the support member, the peripheral edge of the contact ring being connected to the electrically conductive track via an electrically conductive path under pressure at the electrical transition between the contact ring and the electrically conductive track, wherein the electrically conductive track is disposed on the surface of the support member.

19. A rotation connector adapted to the transmission of electrical signals from a first device to a second device, which second device is rotatable with respect to the first device, which comprises:

a substantially dielectric support member having a longitudinal direction and provided with a first end portion and a second end portion, said dielectric support member having an electrically conductive track extending in the longitudinal direction as far as the region of the second end portion, a self-supporting contact ring having an electrically conductive peripheral edge and an inner edge defining a recess around the center-line of the contact ring, said contact ring being fixed on the support member, said recess substantially enclosing the support member in such a manner that the center-line of the contact ring is substantially parallel to the longitudinal direction of the support member, the peripheral edge of the contact ring being connected to the electrically conductive track via an electrically conductive path, said contact ring being a plastic product provided with a conductive coating which provides at least a part of the conductive path, wherein the electrically conductive track is disposed on the surface of the support member.

* * * * *